US005096746A

United States Patent [19]

Strizki

[11] Patent Number: 5,096,746

[45] Date of Patent: Mar. 17, 1992

[54] DUAL ORIFICE NOZZLE AND METHOD FOR INTERALLY COATING CONTAINERS

[75] Inventor: Thomas C. Strizki, Denver, Colo.

[73] Assignee: Ball Corporation, Muncie, Ind.

[21] Appl. No.: 597,251

[22] Filed: Oct. 15, 1990

[51] Int. Cl.[5] ..... B05D 7/22

[52] U.S. Cl. ..... 427/236; 427/233; 427/234; 239/550; 239/600; 118/315; 118/317

[58] Field of Search ..... 427/233, 234, 236; 239/550, 565, 596, 600; 118/315, 317

[56] References Cited

U.S. PATENT DOCUMENTS

| | | | |
|---|---|---|---|
| 2,124,853 | 7/1938 | Grupe | 118/317 X |
| 2,895,449 | 7/1959 | Oldfield, Jr. | 118/317 X |
| 3,270,966 | 9/1966 | Ackley | 239/550 |
| 3,697,313 | 10/1972 | Stumphauzer et al. | 427/233 |
| 3,726,711 | 4/1973 | Hogstrom | 118/318 X |
| 3,797,456 | 3/1974 | Hogstrom | 118/318 X |
| 4,278,709 | 7/1981 | Sullivan et al. | 427/233 |
| 4,291,640 | 9/1981 | Payne et al. | 427/233 X |
| 4,378,386 | 3/1983 | Rehman | 427/233 |
| 4,661,379 | 4/1987 | Frei et al. | 427/233 X |

*Primary Examiner*—Michael Lusignan
*Assistant Examiner*—Alain Bashore
*Attorney, Agent, or Firm*—Gilbert E. Alberding

[57] ABSTRACT

A nozzle, nozzle assembly and method for internally coating containers uses a dual orifice nozzle and method to direct divergent spray patterns at separate interior surface portions of the container where the coating liquid is most needed and to minimize misting, overspray and waste. The nozzle comprises a generally cylindrical body having a forward portion, a middle portion, a rear portion, a first conduit extending longitudinally therethrough terminating in a first opening disposed in the forward portion, and a second conduit extending longitudinally therethrough terminating in a second opening formed in the forward portion of the body. The first and second openings are oriented at an acute angle with respect to a central longitudinal axis of the nozzle to direct the separate sprays of coating liquid from the body generally in separate patterns diverging from the central longitudinal axis of the nozzle. The conduits are suited to receive airless nozzle inserts that direct the separate spray patterns at the distinct interior portions. In the internal coating method, a flow of coating liquid is divided into first and second flow portions, with the first flow portion directed toward one interior surface portion of the container and the second flow portion toward another separate interior surface portion.

8 Claims, 3 Drawing Sheets

DUAL ORIFICE NOZZLE AND METHOD FOR INTERALLY COATING CONTAINERS

TECHNICAL FIELD

This invention relates to systems and methods for internally coating containers, and more particularly relates to a dual orifice nozzle assembly and method for directing separate spray patterns at offset angles to coat distinct interior surfaces of a container.

BACKGROUND OF THE INVENTION

A method of metal container manufacture in current use by the metal container industry is the two-piece can process. This process involves forming a drawn cup from a metal sheet and then deep drawing the cup into a can configuration. After the can body is completely configurated and decorated, but before the end is assembled onto the body, the interior surface of the can body is coated with a protective coating of a synthetic resin material.

It is conventional practice to apply, as the coating material, a heat hardenable resin dispersed in an aqueous medium which is sprayed into the interior walls of the container. The open-ended can is caused to be passed through an internal coating station, normally a coating "tunnel," where the coating liquid is sprayed into the interior of the can to coat its internal surface. The wet coated container is then passed through an oven in which hot air is circulated to evaporate the aqueous medium and harden the coating.

In some conventional systems, the coating is sprayed into the interior of the container while inverted in an upright position on a reticulated belt. In such systems, as the containers travel through the coating tunnel, the interior surface walls of the containers are contacted with an aqueous dispersion of a coating resin by spraying means, usually comprising a plurality of single orifice nozzles disposed under and along the reticulated belt, which direct a sequence of wide atomized sprays of wet resin coating onto the interior walls.

Substantially all the conventional nozzles used in such applications are of the single orifice type which make controlling the application of the coating to the interior surface difficult, especially near the open end of the container.

The most commonly used airless nozzle includes an internal, hemispherical passage termination which is cut through by an external, V-shaped groove to form an elongated, elliptical-like orifice. Liquid material pumped at high pressures through such a spray nozzle is forced by the hemispherical termination of the passageway to converge in its flow at and through the elongated orifice. Because of the converging flow at the orifice, the liquid material is expelled through the orifice into a planar, expanding, fan-like film which breaks into spray particles which are carried by their momentum to the article target.

Such prior systems are plagued by excessive overspray and nozzle misting, each of which is costly due to the wasted coating resin. In addition, it is desirable to place more coating near the top and the bottom of the can and less in the middle sidewall of the container as the top of the container is worked upon during the necking operation and the bottom of the container is in contact with the pin tip of the pin chain. The middle sidewall normally has minimal contact and needs less coating.

Thus, there has developed in the metallic container manufacturing industry a need for an internal coating nozzle assembly capable of placing the coating where it is most required within the interior of the container while also minimizing the amount of wasted coating liquid normally produced by the operation.

SUMMARY OF THE INVENTION

This invention presents a dual orifice nozzle assembly, device and method which forms two distinct and separate spray patterns offset at acute angles to spray or coat a specific interior area of a container with each respective pattern. An object of this invention is to provide the capability of more efficiently directing coating where it is required most inside the container while minimizing nozzle misting and overspray, thereby decreasing the amount of wasted coating liquid normally generated by the internal coating operation.

Generally, a spray nozzle presented by the invention comprises a generally cylindrical body having a forward portion, a middle portion, a rear portion, a first conduit passageway extending longitudinally therethrough terminating in a first opening formed in the forward portion, and a second conduit passageway extending longitudinally therethrough terminating in a second opening formed in the forward portion of the body. The first and second openings, and preferably the passageways, are each oriented at an acute angle with respect to a central longitudinal axis of the nozzle body to accept spray forming means to direct separate sprays of coating liquid forwardly of the body and generally in separate patterns diverging from the central longitudinal axis of the nozzle.

The first and second openings of the forward portion of the nozzle body are generally circular in shape and equally spaced on opposite sides of the central longitudinal axis. The first opening is preferably formed in a first planar surface which is substantially perpendicular to a longitudinal axis of the first conduit passageway, and the second opening is preferably formed in a second planar surface which is substantially perpendicular to a longitudinal axis of the second conduit passageway. The first planar surface of the forward portion of the nozzle body is disposed at an obtuse angle with respect to the second planar surface.

The middle portion of the nozzle body is generally cylindrical in shape and is smaller in diameter than the rear portion of the nozzle body which is defined by a circular shoulder portion having a recessed cavity formed therein.

At their openings, each of the first and second conduit passageways has a beveled portion adjacent the forward portion of the nozzle body, a small diameter cylindrical portion adjacent the rear portion of the nozzle body, a large diameter cylindrical portion juxtaposed the beveled portion and an internally threaded portion disposed between the beveled portion and the large diameter cylindrical portion.

The spray nozzle of the invention is suitable for threadably receiving a first nozzle insert within the first conduit passageway adjacent the forward portion of the nozzle body for directing a first spray pattern generally toward a first interior portion of the container. Likewise, the second conduit passageway of the nozzle body is suitable for threadably receiving a second nozzle insert adjacent the forward portion of the nozzle body for directing a second spray pattern generally toward a second interior portion of the container. Being received in the first and second conduit passageways, the first and second inserts and their longitudinal axes concomitantly lie at acute angles with respect to the central longitudinal axis of the nozzle.

The spray forming means are preferably generally cylindrical "airless" nozzle inserts having an externally threaded portion to allow them to be threadably received in the internally threaded portions of the first and second conduit passageways. The nozzle inserts act to form a fan-like spray pattern of the coating liquid as it is dispersed.

In use, the spray nozzle of the invention is intended to be arranged with respect to a container to be sprayed so that the longitudinal axis of the nozzle body is disposed at an acute angle in relation to a central longitudinal axis of the container.

In the method of this invention, the first spray forming means of the nozzle body forms the first flow into a first spray pattern and directs this first spray pattern at the first interior portion of the container, which is preferably an area adjacent the open end of the container. The second spray forming means of the nozzle body forms the second flow into a second spray pattern and directs the second spray pattern at a second interior portion of the container, which is preferably adjacent the closed end of the container.

The spray nozzle assembly, device and method presented by the invention directs substantially all of the coating liquid onto the interior surface of the container where it is most effective and minimizes nozzle misting and overspray, thus decreasing wasted coating liquid. The direction of the first and second separate spray patterns near the closed end and the open end of the container results in a film deposited on the interior surface of the container having a greater thickness adjacent the ends thereof. This is primarily where the coating is desired as the middle sidewall generally has minimal contact in manufacture and consequently requires less coating. Further, the invention allows for the use of lower operating spray weights without compromising spray quality and blistering, which is a common problem with higher spray weights.

Thus, the invention provides a nozzle assembly, device and method that directs the internal coating liquid more accurately where it is required inside the can, thereby reducing the amount of coating liquid required in the internal coating process. The invention reduces overspray by directing small, defined spray patterns adjacent the open end of the can and adjacent the closed end of the can. The invention also reduces man hours spent on cleaning the machines and this naturally increases the efficiency of the manufacturing process. Further, the nozzle assembly and device of this invention is less likely to blister than are conventional devices.

Further features of the invention will be apparent from the following drawings and disclosure of preferred embodiments of the invention.

DETAILED DESCRIPTION OF THE PREFERRED EMBODIMENT AND BEST MODE FOR CARRYING OUT THE INVENTION

Figure 1:
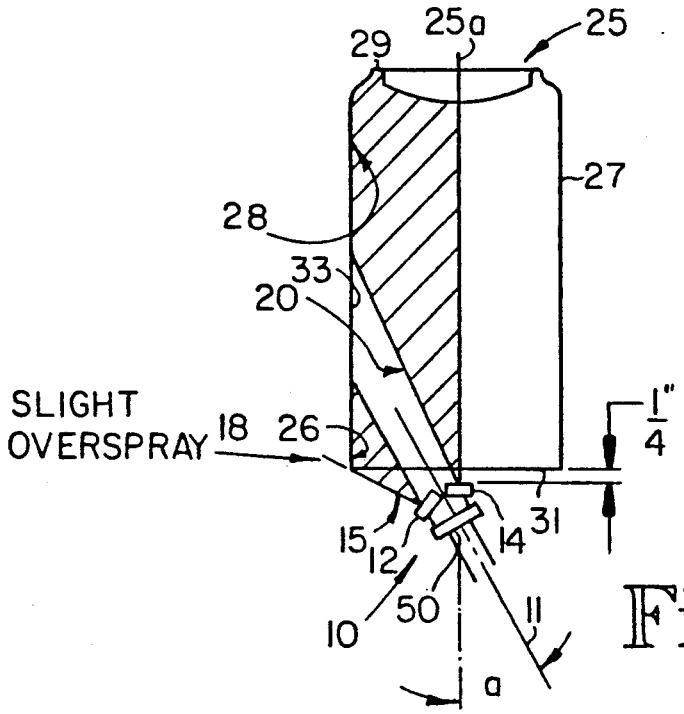
FIG. 1 is a plan view of the operational set-up of the nozzle assembly provided by the invention.

A spray nozzle 50, nozzle assembly 10 and method of use presented by this invention are shown in FIGS. 1–4 where like reference numerals correspond to like components. As shown in FIG. 1, nozzle assembly 10 is intended to be arranged adjacent a container 25 as it is transported along in the manufacture process and includes nozzle 50 and nozzle inserts 12, 14. Container 25 has a generally cylindrical body 27, an closed end 29 and a open end 31. Nozzle assembly 10 forms two distinct and separate spray patterns 15 and 20 that are directed at divergent angles at first and second interior portions 26 and 28, respectively, of the container 25. Thus, first spray pattern 15 is directed at first interior portion 26 of the container and second spray pattern 20 is directed at second interior portion 28 of the container. As noted above, it is at these interior areas 26 and 28 where more coating is desirable because the first interior portion 26 of the container is worked upon during the necking operation and the second interior portion 28 of the container is in contact with the pin tip of the pin chain during manufacture. The middle sidewall portion 33 normally has minimal contact and needs less coating during manufacture.

This invention decreases the amount of wasted coating liquid normally generated by the internal coating operation by minimizing misting and overspray 18 as shown in FIG. 1. The orientation of nozzle assembly 10 with respect to container 25 is such that with relative rotational movement of the container 25 and nozzle assembly 10, the entire bottom surface of the container 25 is coated. In use, nozzle assembly 10 is preferably arranged with respect to container 25 so that the longitudinal axis 11 of the nozzle assembly 10 is disposed at an acute angle "a" of approximately 28–31° in relation to central longitudinal axis 25*a* of the container 25 and about one-quarter inch distance from the open end 31 of the container. This arrangement provides satisfactory coating of the container bottom with commonly available airless nozzle inserts.

Figure 2:
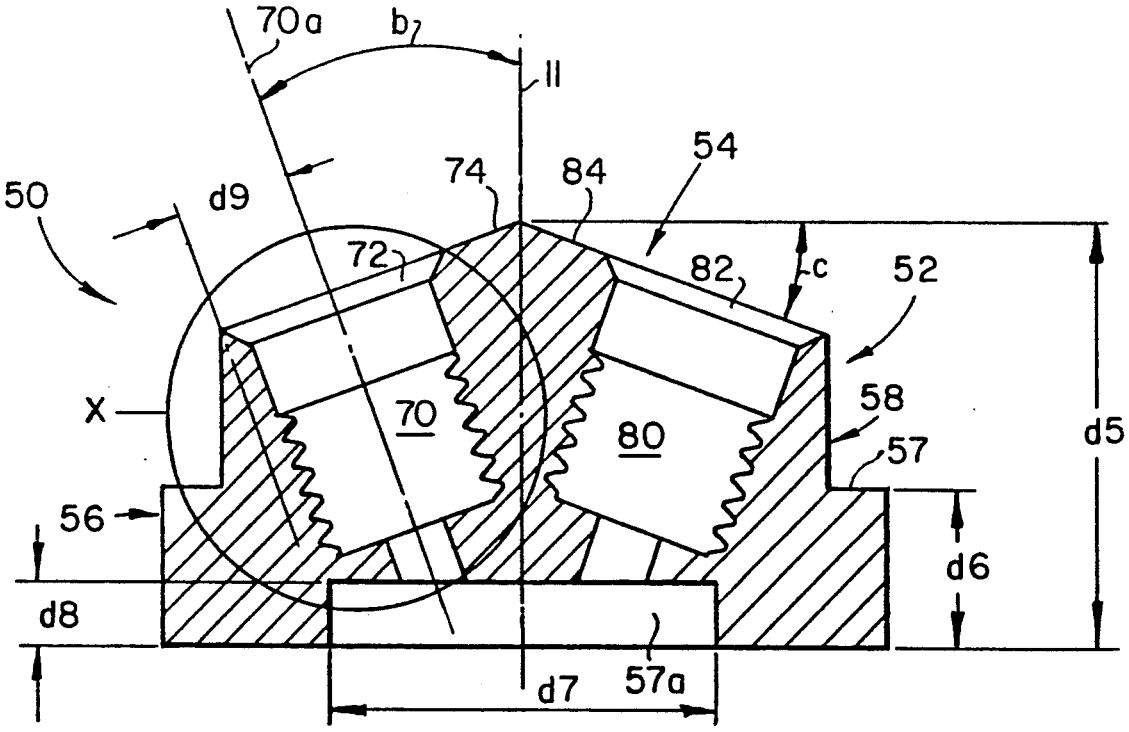
FIG. 2 is a side cross-sectional view of a spray nozzle of the invention, without nozzle inserts, for internal coating application taken along line 2—2 of FIG. 3.
Figure 3:
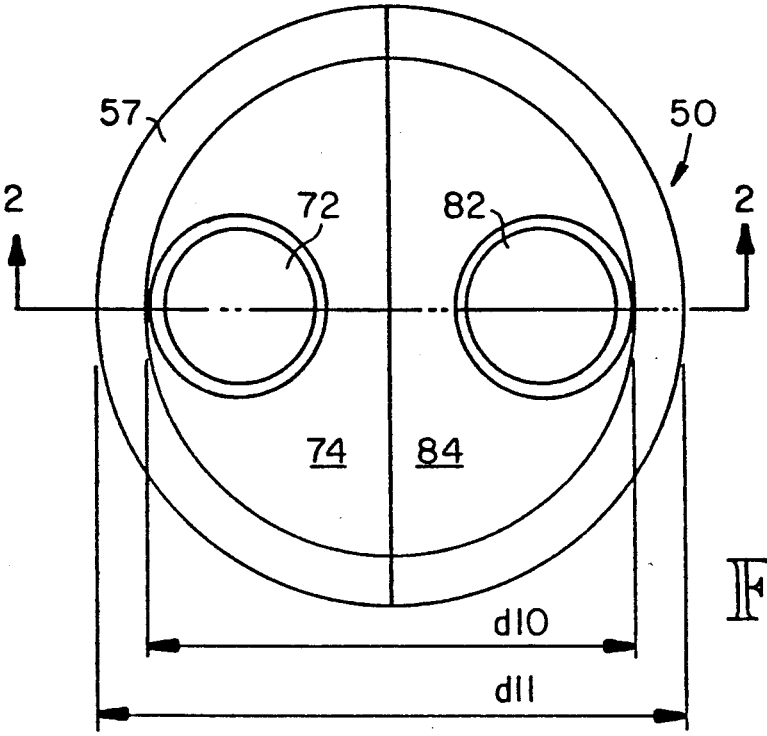
FIG. 3 is a top view of the nozzle of FIG. 2.

Nozzle 50 shown in FIGS. 2 and 3 comprises a generally cylindrical body 52 having a forward portion 54, a rear portion 56, an intermediate portion 58 and nonparallel first and second passageways 70, 80 formed in nozzle body 52. First conduit passageway 70 extends generally longitudinally through the nozzle body 52 and terminates in a first opening 72 disposed in the forward portion 54 of the nozzle. Likewise, second conduit passageway 80 extends generally longitudinally through the nozzle body 52 and terminates in a second opening 82 formed in the forward portion 54 of the nozzle. Conduits 70, 80 are each oriented within the nozzle body 52 at an acute angle "b" with respect to the central longitudinal axis 11 of the nozzle. Acute angle "b" is preferably about 20° . Thus, the divergent arrangement of conduits 70, 80 directs the separate spray patterns 15, 20 generally forward of the nozzle and in separate spray patterns 15, 20 diverging from the central longitudinal axis 11 of the nozzle.

First opening 72 is formed in a first planar surface 74 which is substantially perpendicular to the central longitudinal axis 70*a* of the first conduit 70. Second opening 82 is formed in a second planar surface 84 which is substantially perpendicular to a central longitudinal axis (not shown) of the second conduit 80. Planar surfaces 74 and 84 are each disposed at an acute angle "c" from horizontal. Angle "c" is preferably about 20°. Thus, the included angle between surfaces 74 and 84 is an obtuse angle of about 140°.

Intermediate portion 58 of nozzle body 52 is of generally cylindrical shape and rear portion 56 includes a circular shoulder portion 57 that has a diameter greater than the diameter of the intermediate portion 58. Shoulder portion 57 is provided with a recessed cavity 57*a* formed therein for connecting to a fluid-delivery line carrying the coating fluid from a remote source.

Figure 4:
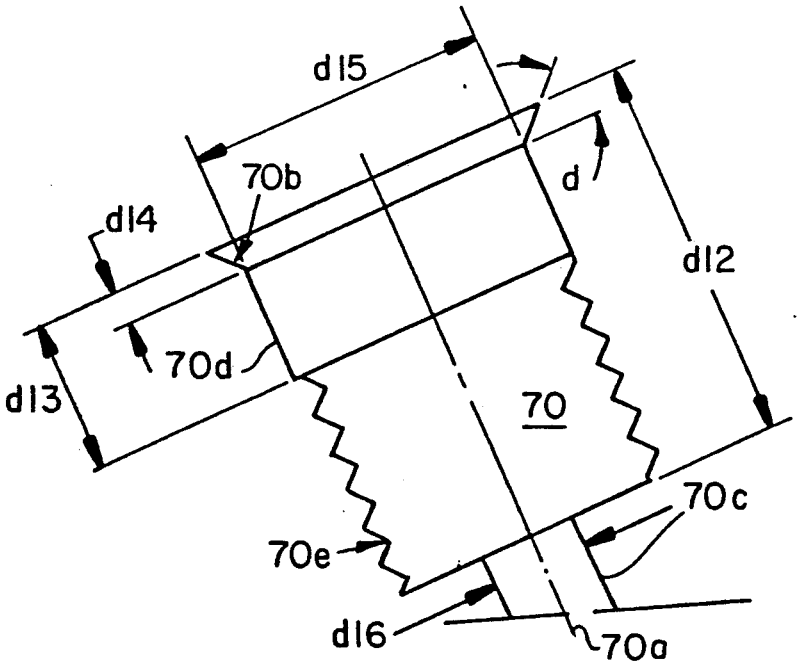
FIG. 4 is an enlarged, isolated partial cross-sectional view of one of the conduit passageways of the nozzle of FIG. 2.

Shown in FIG. 4 is an enlarged, isolated cross-sectional view of an encircled portion "X" of FIG. 2 containing conduit 70. While the description following herein is of the first conduit or passageway 70, said description is equally applicable to second conduit or passageway 80 as said passageways are substantially identical. Conduit 70 is formed in nozzle body 52 as having a beveled portion 70*b* adjacent the forward portion of the nozzle body, a small diameter cylindrical portion 70*c* adjacent the rear portion of the nozzle body, an enlarged diameter cylindrical portion 70*d* juxtaposed to the beveled portion 70*b* and an internally threaded portion 70*e* disposed between the large diameter cylindrical portion 70*d* and small diameter cylindrical portion 70*c*. Internally threaded portion 70*e* is preferably defined by four millimeter metric threads.

As shown in FIG. 3, first and second openings 72, 82 are generally circular in shape are equally spaced on opposite sides of the central longitudinal axis of the nozzle body 52 along line 2—2.

Nozzle 50 of this invention is suited to threadably receive the nozzle insert members 12, 14 (FIG. 1) within the passageways 70, 80, respectively, adjacent the forward portion 54 of the nozzle body 52. First passageway 70 and corresponding nozzle insert 12 direct the first spray pattern 15 generally toward the first interior portion 26 of the container. Likewise, second passageway 80 and insert member 14 direct the second spray pattern 20 generally toward the second interior portion 28 of the container. Each nozzle insert 12, 14 preferably includes an internal, hemispherical passage termination which is cut through by an external, V-shaped groove to form an elongated, elliptical-like orifice. Coating liquid pumped under pressure through the insert is forced by the hemispherical termination of the passageway to converge in its flow at and through the elongated orifice. Because of the converging flow at the orifice, the coating liquid is expelled through the orifice into a planar, expanding, fan-like film which breaks into spray particles which are carried by their momentum to interior portions 26 and 28. Such nozzle inserts are of conventional design so their structure and specific manner of operation are not shown or described herein in detail. Nozzle inserts suitable for use with the nozzle 50 of this invention are manufactured by Nordson Corporation. The method and device of this invention may be further understood by reference to the following examples.

EXAMPLE ONE

Two internal coating lines were established to compare the dual orifice nozzle assembly 10 provided by this invention to a conventional "drum head," single orifice nozzle assembly. The dual orifice nozzle of this invention was coupled to an internal coating machine and was operated continuously for about two and one-half days at 160–170 mg spray weights using an internal coating fluid manufactured by Glidden, Model No. 559 IC coating. Overspray was captured by an overspray box. Sample test results are shown below in Table One:

TABLE One

| | Average Spray Wt. mg | Metal Exposure Average 1st Pass After Necker | Metal Exposure High | Metal Exposure Low |
|---|---|---|---|---|
| Dual orifice nozzle (35-can sample) | 167 mg | 1.0 mA | 2 mA | 0 mA |
| Control cans (35-can sample) | 198 mg | .89 mA | 2 mA | 0 mA |

The overspray box coupled to the internal coating machine equipped with nozzle assembly 10 of the invention did not require changing over the two and one-half day period during which the internal coater was operated whereas the conventional coating machine using the standard single orifice nozzle assembly generally required changing once per 12-hour shift. It is estimated that the dual orifice nozzle assembly of this invention reduced overspray by approximately 70 percent.

EXAMPLE TWO

A conventional spray gun equipped with the dual orifice nozzle assembly 10 of this invention was set up on a coating line and continuously operated in the 145–155 mg range. No metal exposure problems were incurred. Tests were also conducted to compare overspray, film weight distribution, and metal exposure with a standard internal coating set-up which employed a conventional single orifice drum head nozzle manufactured by Nordson, Model No. 092-064 equipped with a turbulence plate Model No. 027-309.

The two machines were operated approximately the same length of time and an overspray comparison was then made. The overspray boxes were emptied on both machines and the time was recorded; and, after 12 hours, the overspray boxes were again removed and weighed. The results are shown below in Table Two:

TABLE Two

| | Gun with Conventional Single Nozzle | Gun with Dual Orifice Nozzle Assembly of this Invention |
|---|---|---|
| Overspray weight (12 hours) | 12 lbs. | 4.5 lbs. |
| Spray weight avg. | 151 mg | 153 mg |

A 50-can sample from each gun was then taken from the palletizer and checked for metal exposure. The results are shown below in Table Three:

TABLE Three

| | Spray Weight | Metal Exposure Average | Metal Exposure High | Metal Exposure Low |
|---|---|---|---|---|
| Coater with Conventional Single Nozzle (Control) | 151 mg | .45 mA | 6 mA | 0 mA |
| Coater with Dual Orifice Nozzle of this Invention | 153 mg | .40 mA | 4 mA | 0 mA |

Figure 5A:
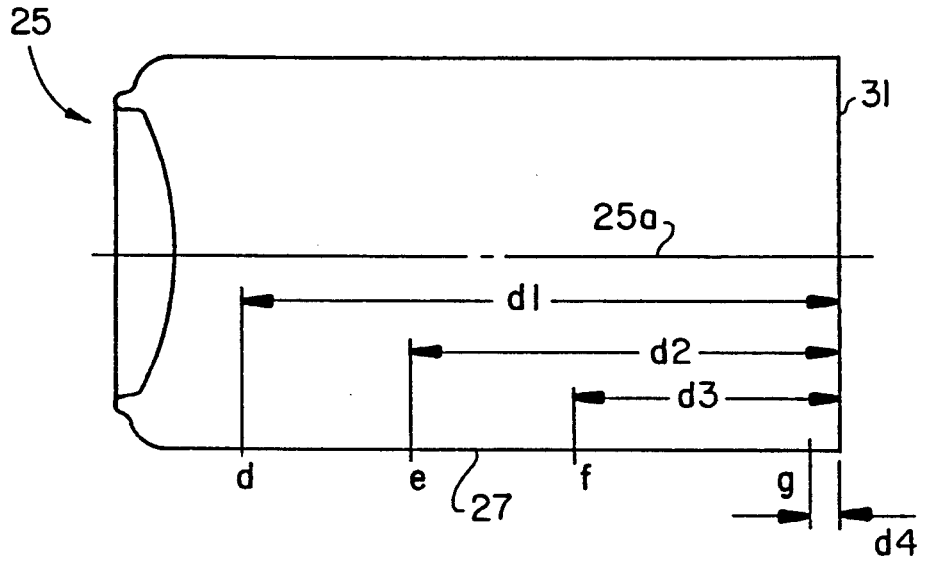
FIGS. 5A and 5B present graphical illustrations of the film thickness comparison achieved by this invention.
Figure 5B:
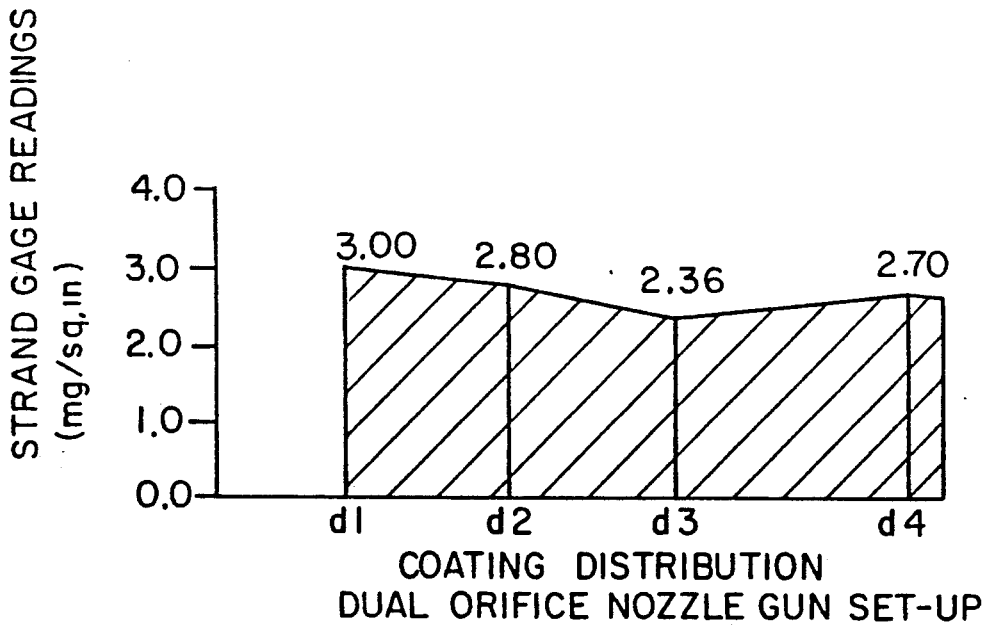

Further, the film weight distribution was then checked from the two machines with a strand gauge. FIG. 5A depicts a conventional "206" gauge aluminum container 25 and FIG. 5B illustrates the film thickness distribution of the coating liquid sprayed on the interior of the can measured at spaced points along the inside surface of the container body 27. As shown in FIG. 5A, the measurements were taken at points "d", "e", "f" and "g" which were at distances of 4.00 inches, 2.875 inches, 1.75 inches and 0.25 inches, respectively, measured from open end 31 of the container. The results of the gauge readings are illustrated in FIG. 5B in which milligrams per square inch of coating liquid is measured on the vertical axis and the distances d1, d2, d3 and d4 from which measurements at d, e, f and g, respectively, were taken are shown on the horizontal axis. The smallest measurement occurs at point "f" which generally corresponds to the middle portion 33 of the container wall as shown in FIG. 1. Measurements taken at points "d" and "e" generally correspond to the second interior portion 28 at which second spray pattern 20 is directed as shown in FIG. 1; and the measurements taken at point g generally correspond to the first interior portion 26 at which first spray pattern 15 is directed. Thus, the nozzle and method of this invention directs the internal coating liquid more efficiently where it is required most inside the can at interior portions 26, 28. While the strand gauge was not calibrated, the resulting values are useful for relative comparison. The readings represented in FIG. 5B were average readings taken from five can samples.

Lastly, the spray weights on the conventional control coater and the coater equipped with the dual orifice nozzle assembly of this invention were increased to 180–185 mg and checked for blistering. The dual orifice nozzle set-up did not blister at this weight whereas the conventional set-up produced moderate blistering.

In the manufacture of the nozzle device of this invention, the following dimensions referred to in the Figures and listed below in Table Four are preferred:

TABLE Four

| Dimension | Value (inches) |
|---|---|
| d5 | 0.3370 |
| d6 | 0.1250 |
| d7 | 0.3125 |
| d8 | 0.0500 |
| d9 | 0.0970 |
| d10 | 0.4900 |
| d11 | 0.5900 |
| d12 | 0.2000 |
| d13 | 0.0750 |
| d14 | 0.0200 |
| d15 | 0.1590 |
| d16 | 0.0520 |
| **Angle** | **Degree** |
| a | 28–31 |
| b | 20 |
| c | 20 |
| d (bevel) | 41 |

Thus, the dual orifice nozzle 50, nozzle assembly 10 and method of operation provided by this invention deposit the internal coating liquid more efficiently where it is most required inside the can, that is, adjacent the open end of the can and the closed end of the can; reduce overspray by directing two separate, small, defined spray patterns at the desired interior portions of the can; reduce overspray by also decreasing the misting of the nozzle, and reduce the likelihood of blistering. These features, among others, reduce the amount of internal coating liquid required as well as reducing man hours spent on cleaning the coating machines.

While what has been described constitutes a presently most preferred embodiment, the invention can take many other forms. Accordingly, it should be understood that the invention is to be limited only insofar as is required by the scope of the following claims.

I claim:

1. A method of internally coating a container comprising the steps of:

delivering a flow of coating liquid to a single nozzle means;

providing the nozzle means and the container with relative rotation;

dividing the coating liquid flow into a first distinct flow portion and a second distinct flow portion within the nozzle means; and directing the first distinct flow portion generally toward a first interior portion of the container and directing the second distinct flow portion generally toward a second interior portion of the container, said first and second distinct flow portions being directed at said first and second interior portions in separate diverging patterns forward of the nozzle means, whereby a non-uniform coating is deposited onto the interior of said container.

2. The internal coating method as in claim 1 wherein said container has a generally cylindrically shaped sidewall, an open end a closed end, wherein said first interior portion of the container is disposed adjacent the open end thereof, wherein said second interior portion of the container is disposed adjacent the closed end thereof, and wherein the coatings deposited on said first and second interior portions are of substantially equal thickness and are of greater thickness than the coating deposited on the middle portion of said container sidewall.

3. The internal coating method as in claim 1 including the step of directing the first and second flow portions in separate diverging patterns at an angle of about 20° with respect to a central longitudinal axis of the nozzle means.

4. The internal spraying method as in claim 3 including the step of arranging the central longitudinal axis of the nozzle means at an acute angle of about 23–31° in relation to a longitudinal central axis of the container being internally coated.

5. The internal coating method as in claim 1 wherein the nozzle means comprises:

a body having a forward portion, a middle portion, a rear portion, a first conduit extending generally longitudinally therethrough terminating in a first opening disposed in the forward portion, and a second conduit extending generally longitudinally therethrough terminating in a second opening formed in the forward portion, said first and second openings being oriented at an acute angle of about 20° with respect to a plane perpendicular to the central longitudinal axis of the nozzle means to direct the first and second portion sprays of the coating liquid in said separate patterns.

6. The internal coating method as in claim 5 wherein said nozzle means further comprises:

a first nozzle insert member positioned within the first conduit adjacent to the forward portion for directing the first spray pattern generally toward the first interior portion of the container; and a second nozzle insert member positioned within the second conduit adjacent to the forward portion for directing the second spray pattern generally toward the second interior pattern of the container.

7. The internal coating method as in claim 6 wherein the first and second nozzle insert members are generally cylindrical and have an externally threaded portion, and wherein the first and second conduits each have internally threaded portions to threadably receive therein the first and second nozzle insert members, respectively, adjacent to the forward portion of the nozzle means.

8. The internal coating method as in claim 1 wherein the first and second flow portions and separate diverging patterns are formed without the use of compressed air by first and second conventional airless nozzles.

* * * * *